US009885452B2

(12) United States Patent
Yuan

(10) Patent No.: US 9,885,452 B2
(45) Date of Patent: Feb. 6, 2018

(54) 3D SWING SIMULATION ELECTRONIC CANDLE LAMP

(71) Applicant: Shenzhen Lycas Electronics Co., LTD, Shenzhen (CN)

(72) Inventor: Dan Yuan, Shenzhen (CN)

(73) Assignee: Shenzen Lycas Electronics Co., LTD, Shenzhen (CN)

( * ) Notice: Subject to any disclaimer, the term of this patent is extended or adjusted under 35 U.S.C. 154(b) by 6 days.

(21) Appl. No.: 14/963,311

(22) Filed: Dec. 9, 2015

(65) Prior Publication Data

US 2017/0122512 A1 May 4, 2017

(30) Foreign Application Priority Data

Nov. 2, 2015 (CN) ..... 2015 1 0731493

(51) Int. Cl.

| | |
|---|---|
| ***F21S 8/00*** | (2006.01) |
| ***F21S 10/04*** | (2006.01) |
| ***F21S 6/00*** | (2006.01) |
| ***F21S 9/02*** | (2006.01) |
| ***F21V 23/00*** | (2015.01) |
| *F21Y 115/10* | (2016.01) |

(52) U.S. Cl.

CPC ..... *F21S 10/046* (2013.01); *F21S 6/001* (2013.01); *F21S 9/02* (2013.01); *F21S 10/04* (2013.01); *F21V 23/001* (2013.01); *F21V 23/006* (2013.01); *F21Y 2115/10* (2016.08)

(58) Field of Classification Search

CPC ..... F21S 10/046; F21S 6/001; F21S 9/02
USPC ..... 362/269, 270, 271, 272, 285, 286, 287
See application file for complete search history.

(56) References Cited

U.S. PATENT DOCUMENTS

| | | | | |
|---|---|---|---|---|
| 9,074,759 | B2 | 7/2015 | Lai | |
| 9,657,910 | B2 * | 5/2017 | Patton | F21S 10/046 |
| 2014/0177212 | A1 * | 6/2014 | Li | F21S 6/001 362/190 |
| 2014/0218903 | A1 * | 8/2014 | Sheng | F21S 10/04 362/190 |

(Continued)

FOREIGN PATENT DOCUMENTS

| | | |
|---|---|---|
| CN | 202613303 U | 12/2012 |
| CN | 202747231 U | 2/2013 |

(Continued)

OTHER PUBLICATIONS

Japanese Office Action based on Application No. 2015-243738 (6 pages) dated Sep. 6, 2016 (for reference purpose only).

(Continued)

*Primary Examiner* — Paultep Savusdiphol
(74) *Attorney, Agent, or Firm* — Viering, Jentschura & Partner mbB

(57) ABSTRACT

A 3D swing simulation electronic candle lamp includes a retaining device and a swing device. The swing device is installed on the retaining device. The swing device is able to swing in an upright direction. A fake flame is provided and retained on the swing device. The beneficial effect of the present invention is that the fake flame is provided and retained on the swing device and the swing device is installed on the retaining device, enabling the fake flame to swing freely in an upright direction along with the swing device so as to imitate the swing effect of a real flame.

8 Claims, 6 Drawing Sheets

(56) References Cited

U.S. PATENT DOCUMENTS

| | | | | |
|---|---|---|---|---|
| 2014/0241004 | A1* | 8/2014 | Chen | F21S 10/04 362/569 |
| 2014/0362592 | A1* | 12/2014 | Lee | F21S 10/046 362/386 |
| 2015/0036348 | A1 | 2/2015 | Dong | |
| 2015/0233538 | A1* | 8/2015 | Sheng | F21S 10/046 362/190 |
| 2015/0292697 | A1* | 10/2015 | Lai | F21S 10/046 362/286 |
| 2016/0053954 | A1* | 2/2016 | Lai | F21S 10/046 362/393 |
| 2017/0067608 | A1* | 3/2017 | Patton | F21S 10/046 |

FOREIGN PATENT DOCUMENTS

| | | | |
|---|---|---|---|
| CN | 203363973 | U | 12/2013 |
| CN | 203431703 | U | 2/2014 |
| CN | 204213807 | U | 3/2015 |
| CN | 104534396 | A | 4/2015 |
| CN | 204693310 | U | 10/2015 |
| JP | 57132308 | U | 8/1982 |
| JP | 3126714 | B2 | 1/2001 |
| JP | 3183216 | B2 | 7/2001 |
| WO | 2015021066 | A2 | 2/2015 |
| WO | 2015080664 | A1 | 6/2015 |
| WO | 2016101344 | A1 | 6/2016 |

OTHER PUBLICATIONS

European Search Report based on Application No. EP15197245 (9 pages) dated Feb. 23, 2016 (Reference Purpose Only).

Japanese Office Action based on application No. 2015-243738 (5 pages and 4 pages of English translation) dated Mar. 28, 2017.

Chinese Office Action based on application No. 201510731493.0 (7 pages and 9 pages of English translation) dated Aug. 3, 2017.

* cited by examiner

3D SWING SIMULATION ELECTRONIC CANDLE LAMP

RELATED APPLICATIONS

The present application claims priority from Chinese application No.: 201510731493.0 filed on Nov. 2, 2015 and is incorporated herein by reference in its entirety.

TECHNICAL FIELD

The present invention relates to an electronic candle, and more particularly to a 3D swing simulation electronic candle lamp.

BACKGROUND

A candle is a common living appliance. A traditional candle has the problems of pollution and safety. In order to solve these problems, an electronic candle is derived accordingly. The electronic candle is environment-friendly and safe. However, the existing electronic candle only imitates the light of a candle, unable to provide a swinging flame effect like a real candle. The display effect of the electronic candle is not good, and the ornamental value is not high. Accordingly, the inventor of the present invention has devoted himself based on his many years of practical experiences to solve these problems.

SUMMARY

The primary object of the present invention is to provide a 3D swing simulation electronic candle lamp to overcome the shortcomings of the prior art.

In order to achieve the aforesaid object, the 3D swing simulation electronic candle lamp of the present invention comprises a retaining device and a swing device. The swing device is installed on the retaining device. The swing device is able to swing in an upright direction. A fake flame is provided and retained on the swing device.

Preferably, the swing device comprises a power mechanism, a transmission mechanism, and a swing assembly. The fake flame is fixedly connected with the swing assembly. The power mechanism drives the swing assembly through the transmission mechanism.

Preferably, the 3D swing simulation electronic candle lamp further comprises a battery, a controller, and a luminous member. The fake flame has a first accommodation room therein. The luminous member is disposed in the first accommodation room. The luminous member is able to shine after electrified. The battery, the controller, and the luminous member are electrically connected in sequence. The fake flame is made of a light-pervious material. The controller is electrically connected with a control end of the power mechanism.

Preferably, the retaining device comprises a support block fixed on an upper end of the retaining device. An upper end of the support block is a spherical point. The spherical point of the upper end of the support block functions as a swing fulcrum of the swing device. The swing device comprises a swing frame. The fake flame is retained at an upper end of the swing frame. The swing frame is provided with a curved recess to mate with the upper end of the support block. The spherical point of the support block is incorporation with the curved recess.

Preferably, a bottom of the swing frame is provided with a first magnetic member. The power mechanism is a drive motor having the control end electrically connected with the controller. The transmission mechanism comprises a rotary pendant which is fixedly connected with a power output shaft of the drive motor. One end of the rotary pendant extends toward the first magnet member. An extension end of the rotary pendant is provided with a second magnet member.

Preferably, the retaining device further comprises a casing, a base, a cylinder, and a support seat. The base, the cylinder, and the support seat are installed in the casing. The support seat extends upward out of the upper end of the cylinder and is fixedly connected with the casing. The drive motor and the rotary pendant are installed in the casing.

Preferably, the cylinder has an interior space installed with a positive and negative battery plate, a battery compartment, and a battery positive and negative PCB board which are arranged from bottom to top. Upper and lower ends of the battery compartment are provided with conductive through holes, respectively. Terminals on the positive and negative battery plate and terminals on the battery positive and negative PCB board are respectively inserted through the conductive through holes to form a power supply circuit. The base is provided with a battery hole for installation of a battery. The battery hole is provided with a battery lid.

Preferably, the 3D swing simulation electronic candle lamp further comprises a cover. The cover is adapted to cover the retaining device and the swing device. An upper end of the cover is provided with a through hole. The fake flame passes through the through hole.

Preferably, the luminous member is electrically connected with the main control PCB board through gold-plated fiber wires or silver-plated fiber wires.

The beneficial effect of the present invention is that the fake flame is provided and retained on the swing device and the swing device is installed on the retaining device, enabling the fake flame to swing freely in an upright direction along with the swing device so as to imitate the swing effect of a real flame.

DETAILED DESCRIPTION

Figure 1:
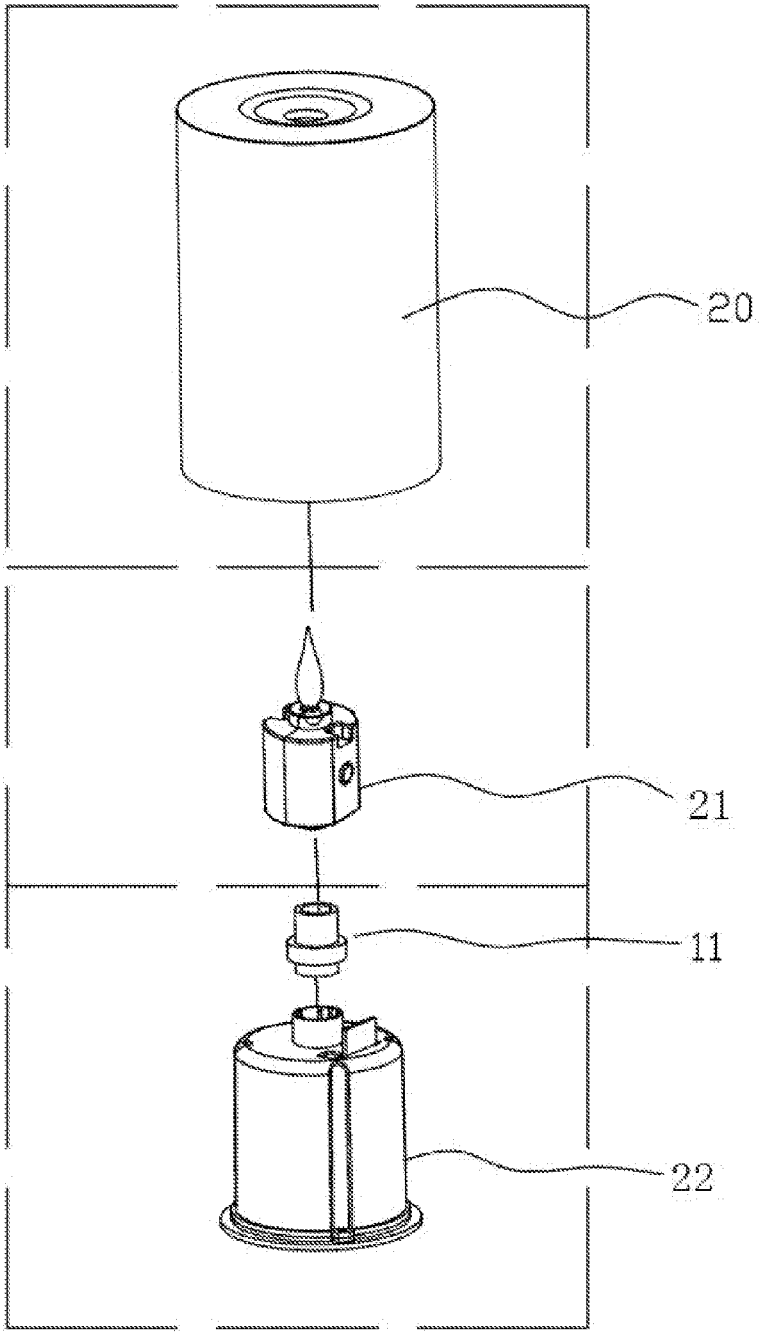
FIG. 1 is an exploded view of the present invention.

Embodiments of the present invention will now be described, by way of example only, with reference to the accompanying drawings. The description of the foregoing embodiments should be able to enable a person of ordinary skill in the art to fully understand the operation, use, and effects of the present invention. The embodiments, however, are only some preferred ones of the present invention and are not intended to be restrictive of the scope of the present invention. All simple equivalent changes and modifications made accordingly to the appended claims and the present specification should fall within the scope of the present invention.

As shown in FIG. 1 through FIG. 6, the present invention discloses a 3D swing simulation electronic candle lamp. The 3D swing simulation electronic candle lamp comprises a retaining device and a swing device. The swing device is installed on the retaining device. A fake flame 1 is provided and retained on the swing device, enabling the fake flame 1 to swing freely in an upright direction along with the swing device so as to imitate the swing effect of a real flame.

Based on the forgoing technique, the swing device comprises a power mechanism, a transmission mechanism, and a swing assembly. The fake flame 1 is fixedly connected with the swing assembly. The power mechanism drives the swing assembly through the transmission mechanism.

Based on the forgoing technique, the present invention further comprises a battery, a controller, and a luminous member 2. The fake flame 1 has a first accommodation room therein. The luminous member 2 is disposed in the first accommodation room. The luminous member 2 is able to shine after electrified. The battery, the controller, and the luminous member 2 are electrically connected in sequence. The fake flame 1 is made of a light-pervious material, such that the light of the luminous member 2 penetrates through the fake flame 1 to be seen. This ensures that the fake flame 1 can be seen in a bad illumination condition. The color of the light from the luminous member 2 can be changed. The luminous member 2 is selected from an LED light. The controller is electrically connected with a control end of the power mechanism. The power output mode of the power mechanism is controlled by the controller. For example, if the power is outputted continuously, the fake flame 1 will swing at the same breadth; if the power is outputted intermittently, the fake flame 1 will swing at different breadths.

The controller comprises a main control PCB board 14 installed inside a cylinder 12 and a switch 15 installed outside the cylinder 12. The switch 15 is also installed on the main control PCB board 14. The switch 15 is adapted to control the power supply of the power supply circuit.

Based on the forgoing technique, the retaining device comprises a support block 4 fixed on an upper end of the retaining device. An upper end of the support block 4 is a spherical point. The spherical point of the upper end of the support block 4 functions as a swing fulcrum of the swing device. The swing device comprises a swing frame 3. The fake flame 1 is retained at an upper end of the swing frame 3. The swing frame 3 is provided with a curved recess to mate with the upper end of the support block 4. The spherical point of the support block 4 is in corporation with the curved recess, enabling the swing frame 3 to swing freely relative to the spherical point (as shown in the direction of the arrows A-A of FIG. 3). Because the swing frame 3 can swing freely relative to the spherical point, the fake flame 1 can swing freely along with the swing frame 3 (as shown in the direction of the arrows B-B of FIG. 3) to provide a realistic effect like a real candle to burn and swing.

Based on the forgoing technique, the bottom of the swing frame 3 is provided with a first magnetic member 6. The power mechanism is a drive motor 8 which has the control end electrically connected with the controller. The transmission mechanism comprises a rotary pendant 5 which is fixedly connected with a power output shaft of the drive motor 8. One end of the rotary pendant 5 extends toward the first magnet member 6. An extension end of the rotary pendant 5 is provided with a second magnet member 7. The drive motor 8 brings the rotary pendant 5 to turn. Along with turning of the rotary pendant 5, the first magnet member 6 and the second magnet member 7 are to approach or away from each other, such that the second magnet member 7 is changed by the attraction force (the magnetic poles of the face-to-face surfaces of the first magnet member 6 and the second magnet member 7 are different) or the repulsion force (the magnetic poles of the face-to-face surfaces of the first magnet member 6 and the second magnet member 7 are the same) of the first magnet member 6. The second magnet member 7 subject to the force of the first magnet member 6 brings the swing frame 3 to swing. Through the magnets, the swing frame 3 generates a corresponding swing along with the turning of the rotary pendant 5.

The shape of the swing frame 3 is a frame to decrease its weight. Two sides of the swing frame 3 are symmetrically disposed at two sides of the central symmetrical axle of the swing for the swing frame 3 to balance and return. The rotary pendant 5 is located in the swing frame 3. The central symmetrical axle of the swing frame 3 penetrates through the extension end of the rotary pendant 5. This ensures that when the extension end of the rotary pendant 5 is turned to the closest distance relative to the second magnet member 7, the action force of the two magnet members is the biggest.

The retaining device further comprises a casing 9. A support seat 11 is fixedly connected to an upper end of the cylinder 12. The support seat 11 extends upward out of the upper end of the cylinder 12 and is fixedly connected with the casing 9. The drive motor 8 and the rotary pendant 5 are installed in the casing 9.

The cylinder 12 has an interior space installed with a positive and negative battery plate 18, a battery compartment 16, and a battery positive and negative PCB board 13 which are arranged from bottom to top. Upper and lower ends of the battery compartment 16 are provided with conductive through holes, respectively. Terminals on the positive and negative battery plate 18 and terminals on the battery positive and negative PCB board 13 are respectively inserted through the conductive through holes to form a power supply circuit. The base is provided with a battery hole for installation of a battery. The battery hole is provided with a battery lid 19. The battery is mounted in the battery compartment 16 to prevent the battery from shaking, enabling the power supply circuit to supply stable power. The battery lid 19 is installed in the battery hole in a snap-in manner for convenient assembly and disassembly.

The luminous member 2 is electrically connected with the main control PCB board 14 through gold-plated fiber wires or silver-plated fiber wires.

The present invention further comprises a cover 20. The cover 20 is adapted to cover the retaining device and the swing device. An upper end of the cover 20 is provided with a through hole. The fake flame passes through the through hole. The cover 20 is made of solid wax or a plastic material.

Figure 2:
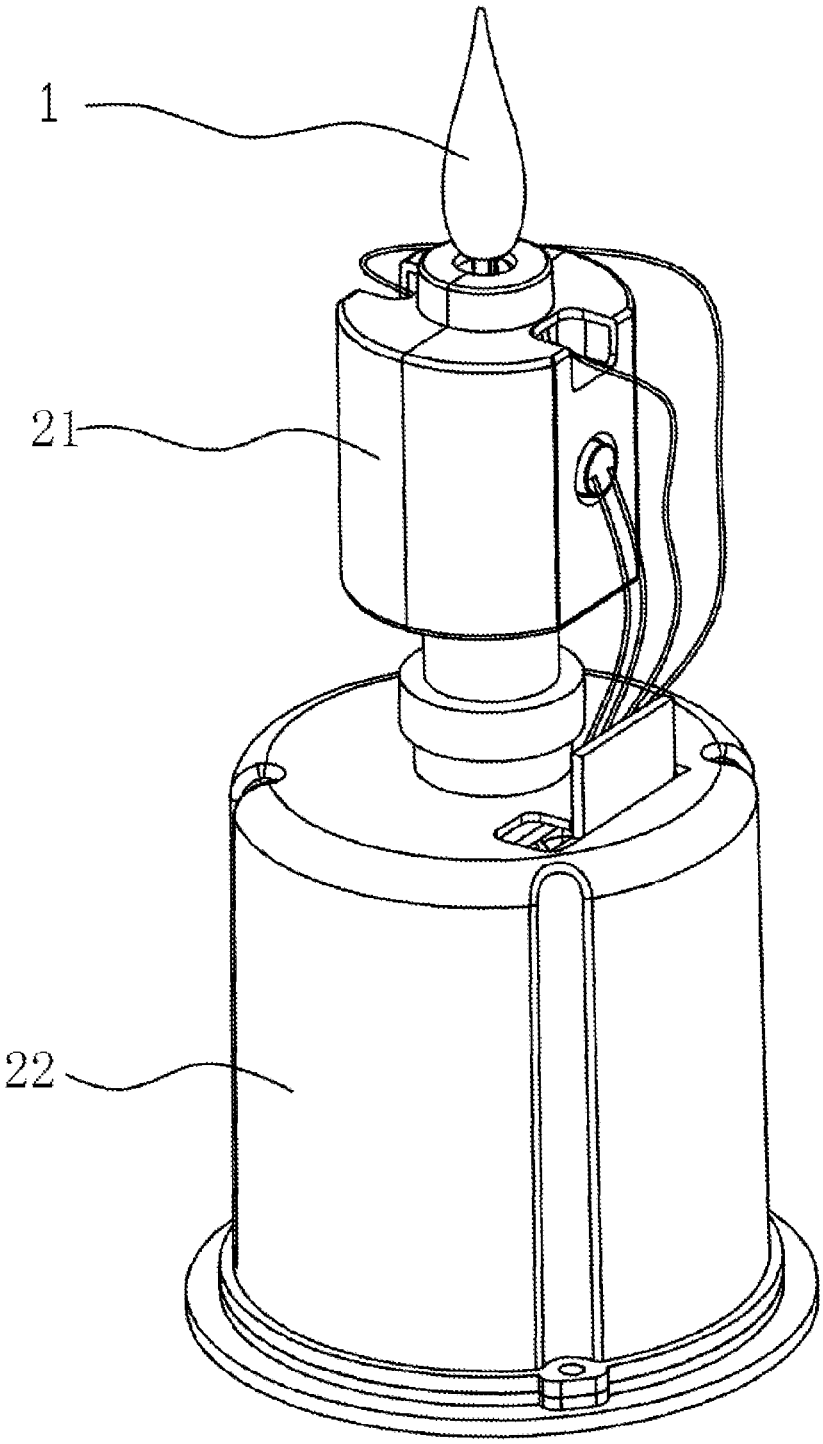
FIG. 2 is a perspective view of the present invention.
Figure 3:
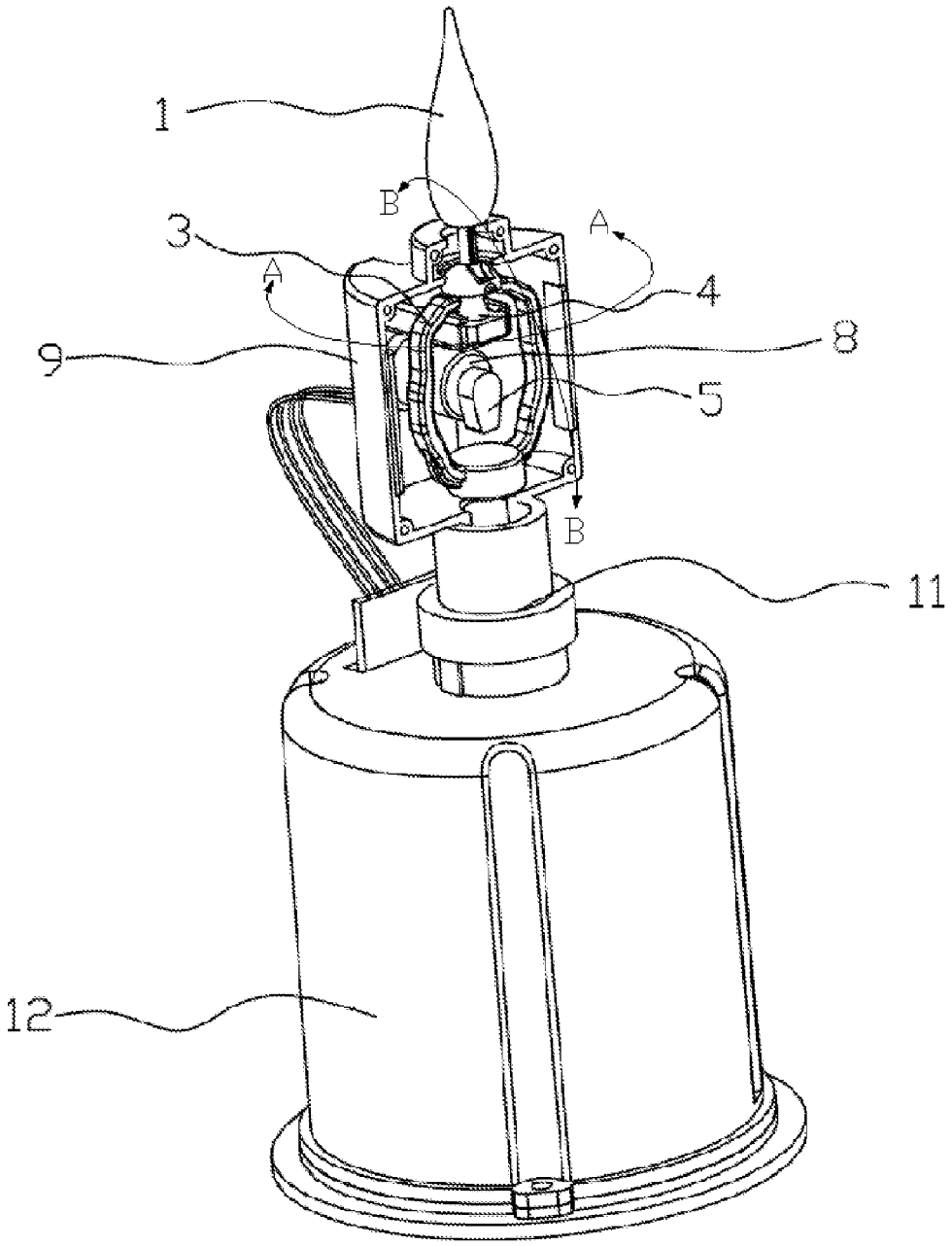
FIG. 3 is a schematic view showing the working principle of the present invention.
Figure 4:
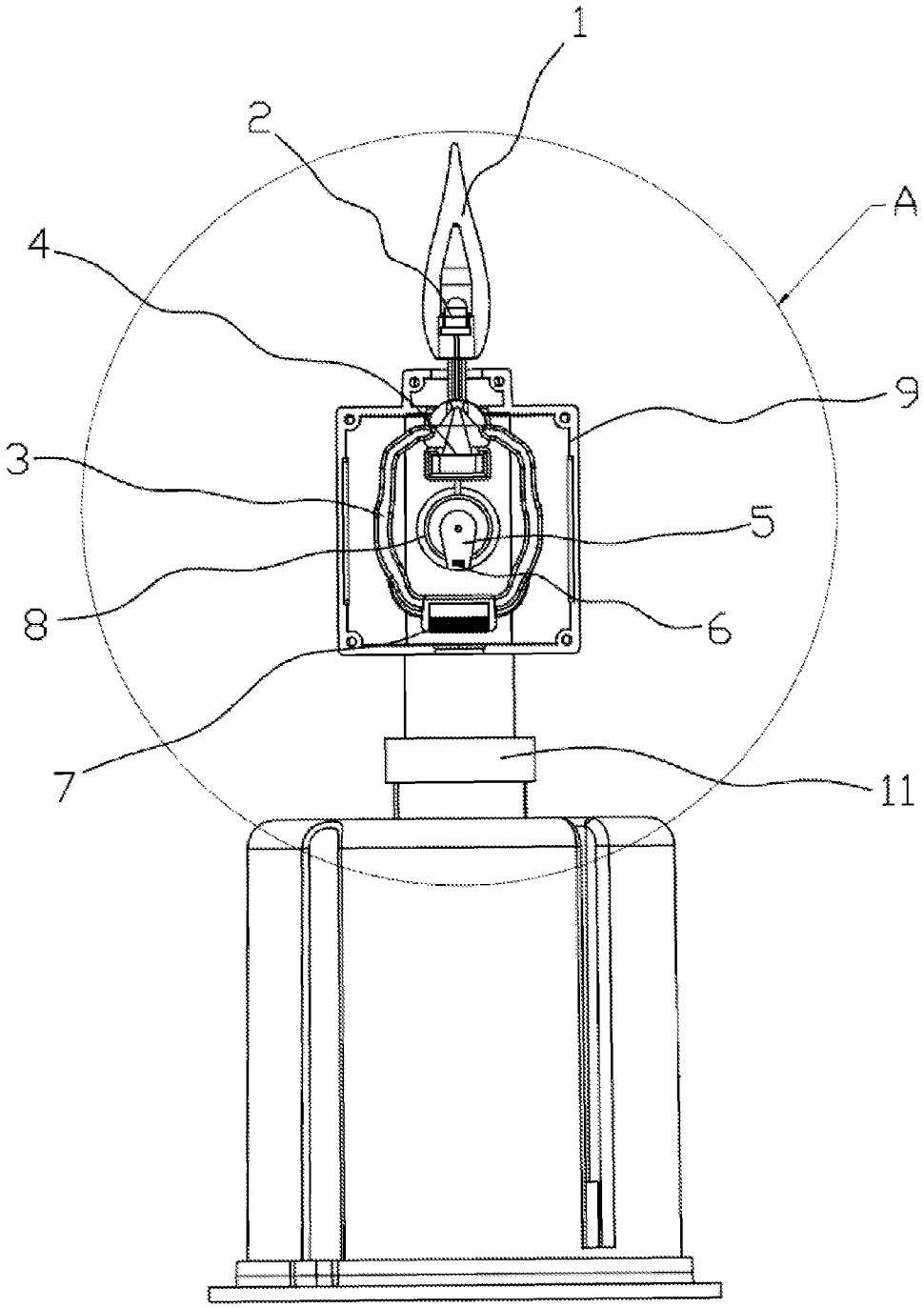
FIG. 4 is a partial sectional view of the present invention.

As shown in FIG. 1 and FIG. 2, the present invention comprises the cover 20, a light holder device 21, and a base 22 which are arranged from top to bottom.

The light holder device 21 comprises the fake flame 1, the casing 9, and the luminous member 2, the swing frame 3, the rotary pendant 5, and the drive motor 8 which are installed in the casing 9. The functional module can shine and swing.

The base 22 comprises the support block 4, the support seat 11, the cylinder 12, the battery positive and negative PCB board 13, the main control PCB board 14, the switch 15, the battery compartment 16, the positive and negative battery plate 18, and the battery lid 19. The module provides a support for the present invention and a power source for the turning of the drive motor 8, and controls the turning speed and the turning direction of the drive motor 8 so as to control the swing breadth of the fake flame 1.

The present invention can be assembled in accordance with the functions, has a simple structure, and can be produced and maintained conveniently.

The present invention has the following features:

1. The swing way uses a point as a swing fulcrum. The swing angle is not limited.

2. The curved recess of the swing device is in corporation with the spherical point of the support block.

3. The magnetism of the magnet in the rotary pendant is weak, and the magnetism of the magnet in the swing frame is strong.

4. The drive motor brings the rotary pendant to turn in an intermittent manner.

Figure 5:
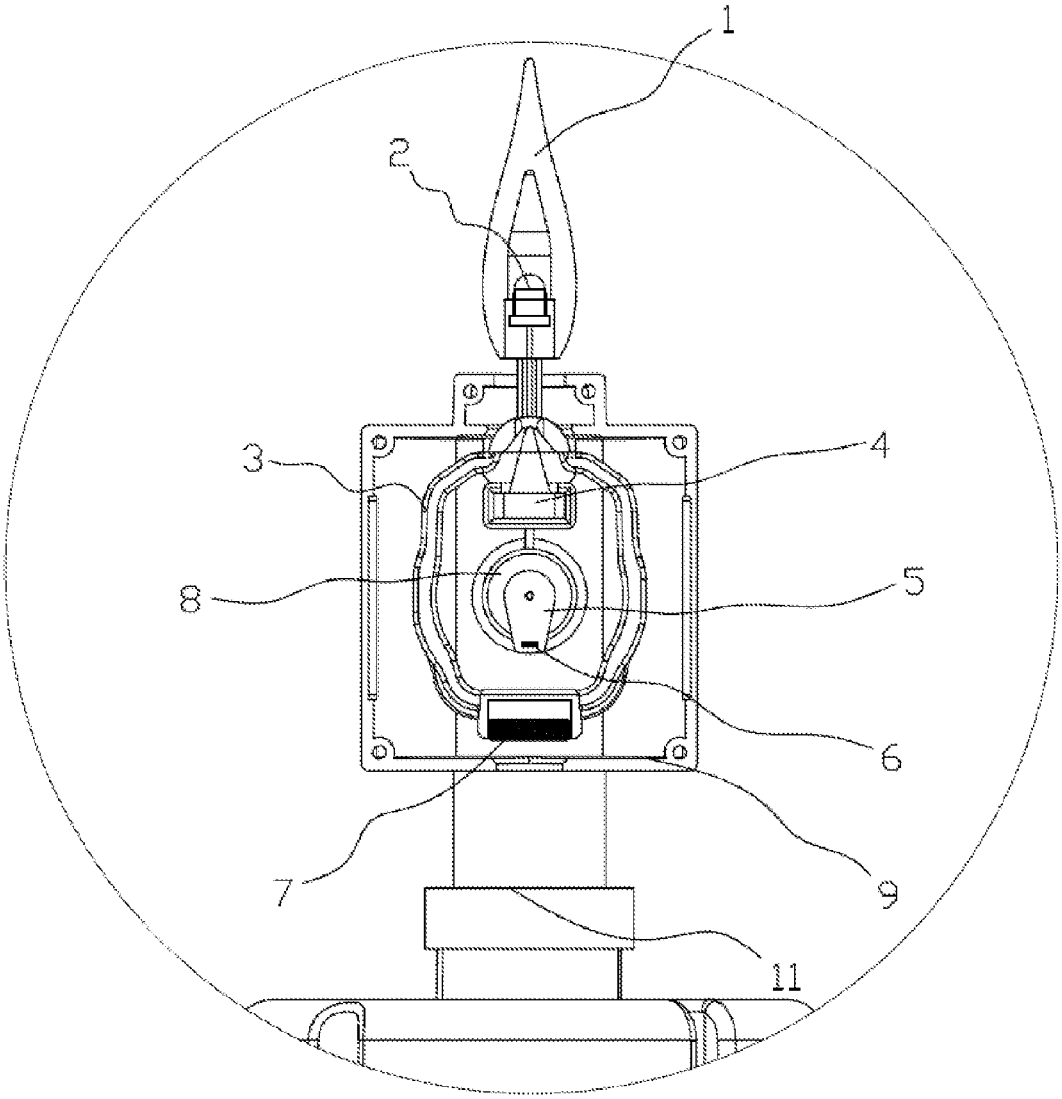
FIG. 5 is an enlarged view of the area A of FIG. 4.
Figure 6:
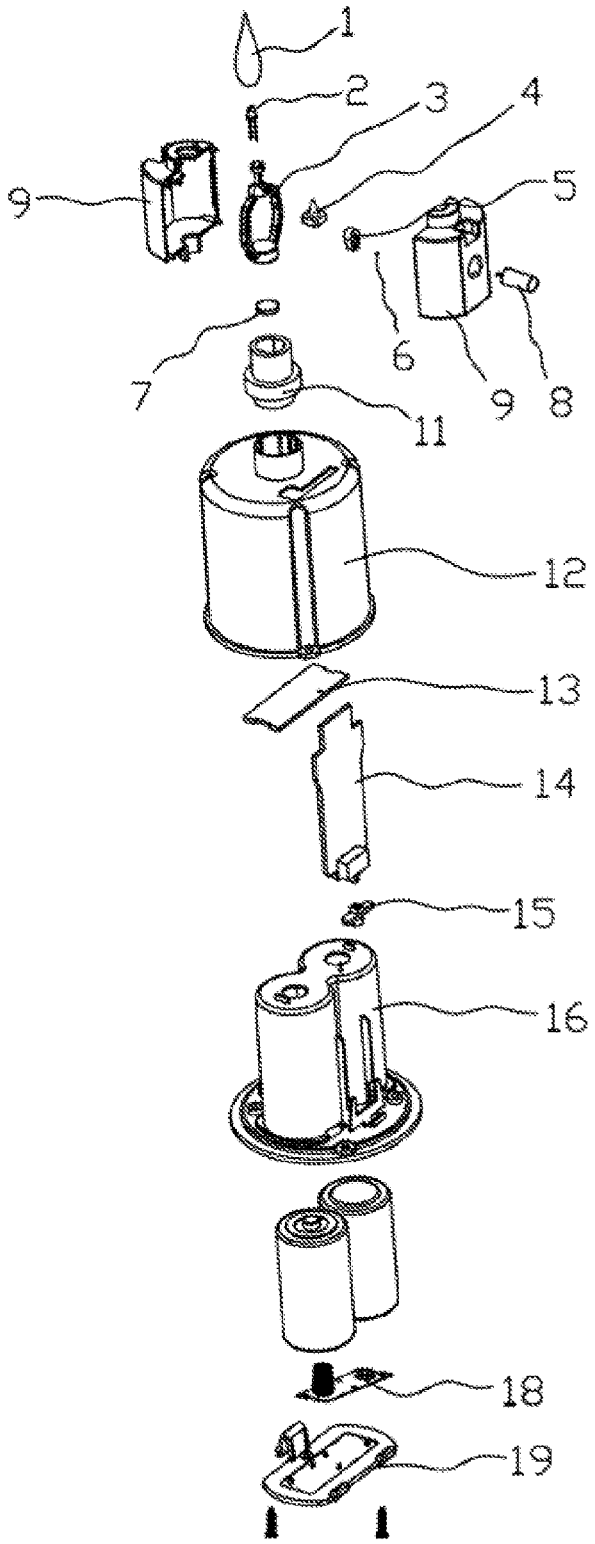
FIG. 6 is another exploded view of the present invention.

5. The surface of the light source is provided with blue adhesive paper (or in other colors) as shown in FIG. 5, such that the light source is colorful.

6. The PCB board can control the swing breadth of the flame and the lightness of the light source.

7. The luminous member is electrically connected with the main control PCB board through silver-plated (gold-plated) fiber wires.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A 3D swing simulation electronic candle lamp, comprising:

a retaining device;

a swing device; and wherein the swing device being installed on the retaining device, and the swing device being able to swing in an upright direction along with the swinging device, a fake flame being provided and retained on the swing device;

wherein the retaining device comprises a support block fixed on an upper end of the retaining device, an upper end of the support block is a spherical point, the spherical point of the upper end of the support block functions as a swing fulcrum of the swing device, the swing device comprises a swing frame, the fake flame is retained at an upper end of the swing frame, the swing frame is provided with a curved recess to mate with the upper end of the support block, and the spherical point of the support block is incorporation with the curved recess, and wherein a first magnetic member is provided on a rotary pendant, which is located inside the swing frame and a second magnet member is provided on the swing frame.

2. The 3D swing simulation electronic candle lamp as claimed in claim 1, wherein the swing device comprises a power mechanism, a transmission mechanism and a swing assembly, the fake flame is fixedly connected with the swing assembly, and the power mechanism drives the swing assembly through the transmission mechanism.

3. The 3D swing simulation electronic candle lamp as claimed in claim 2, further comprising:

a battery, a controller, and a luminous member, the fake flame having a first accommodation room therein, the luminous member being disposed in the first accommodation room, the luminous member being able to shine after electrified, the battery, the controller, and the luminous member being electrically connected in sequence, the fake flame being made of a light-pervious material, and the controller being electrically connected with a control end of the power mechanism.

4. The 3D swing simulation electronic candle lamp as claimed in claim 3, wherein the power mechanism is a drive motor having the control end electrically connected with the controller, the transmission mechanism comprises the rotary pendant which is fixedly connected with a power output shaft of the drive motor, and one end of the rotary pendant extends toward the first magnet member.

5. The 3D swing simulation electronic candle lamp as claimed in claim 4, wherein the retaining device further comprises a casing, a base, a cylinder and a support seat, the base, the cylinder and the support seat are installed in the casing, the support seat extends upward out of the upper end of the cylinder and is fixedly connected with the casing, and the drive motor and the rotary pendant are installed in the casing.

6. The 3D swing simulation electronic candle lamp as claimed in claim 5, wherein the cylinder has an interior space installed with a positive and negative battery plate, a battery compartment, and a battery positive and negative PCB board which are arranged from bottom to top, upper and lower ends of the battery compartment are provided with conductive through holes respectively, terminals on the positive and negative battery plate and terminals on the battery positive and negative PCB board are respectively inserted through the conductive through holes to form a power supply circuit, the base is provided with a battery hole for installation of a battery, and the battery hole is provided with a battery lid.

7. The 3D swing simulation electronic candle lamp as claimed in claim 6, further comprises a cover, the cover being adapted to cover the retaining device and the swing device, an upper end of the cover being provided with a through hole, the fake flame passing through the through hole.

8. The 3D swing simulation electronic candle lamp as claimed in claim 6, wherein the luminous member is electrically connected with the main control PCB board through gold-plated fiber wires or silver-plated fiber wires.

* * * * *